US010816296B2

(12) United States Patent
Karchon et al.

(10) Patent No.: US 10,816,296 B2
(45) Date of Patent: Oct. 27, 2020

(54) TRITIUM FIREARM SAFETY SELECTOR

(71) Applicant: Cammenga Company, LLC, Dearborn, MI (US)

(72) Inventors: Christopher J. Karchon, Birmingham, MI (US); Alexander J. Karchon, Birmingham, MI (US)

(73) Assignee: SHERPA ENTERPRISES LLC, Dearborn, MI (US)

( * ) Notice: Subject to any disclaimer, the term of this patent is extended or adjusted under 35 U.S.C. 154(b) by 0 days.

(21) Appl. No.: 16/684,933

(22) Filed: Nov. 15, 2019

(65) Prior Publication Data

US 2020/0240731 A1 Jul. 30, 2020

Related U.S. Application Data

(60) Provisional application No. 62/836,876, filed on Apr. 22, 2019, provisional application No. 62/825,109, filed on Mar. 28, 2019, provisional application No. 62/767,645, filed on Nov. 15, 2018.

(51) Int. Cl.
*F41A 17/46* (2006.01)
*F41A 19/46* (2006.01)

(52) U.S. Cl.
CPC ..... *F41A 17/46* (2013.01); *F41A 19/46* (2013.01)

(58) Field of Classification Search
CPC ..... F41A 17/64; F41A 17/70; F41A 17/74; F41A 17/80; F41A 17/46; F41A 17/52; F41A 17/56; F41A 17/62
USPC ..... 42/70.01
See application file for complete search history.

(56) References Cited

U.S. PATENT DOCUMENTS

| | | | | |
|---|---|---|---|---|
| 6,250,008 | B1 * | 6/2001 | Silver | F41A 17/44 42/70.01 |
| 8,806,790 | B1 * | 8/2014 | Huang | F41A 17/74 42/70.08 |
| 9,097,474 | B1 | 8/2015 | Zins et al. | |
| 9,587,897 | B1 * | 3/2017 | Huang | F41A 17/70 |
| D786,649 | S * | 5/2017 | Huang | D8/308 |
| 10,062,464 | B2 | 8/2018 | Karchon et al. | |
| 10,126,081 | B1 * | 11/2018 | Geissele | F41A 19/46 |
| 10,466,002 | B1 * | 11/2019 | Geissele | F41A 19/02 |
| 2012/0151817 | A1 * | 6/2012 | Howe | F41G 1/345 42/132 |
| 2014/0202056 | A1 * | 7/2014 | Ball | F41A 9/62 42/1.02 |
| 2015/0153136 | A1 * | 6/2015 | Howe | F41G 1/345 42/111 |

(Continued)

*Primary Examiner* — Joshua E Freeman
(74) *Attorney, Agent, or Firm* — Dickinson Wright PLLC

(57) ABSTRACT

A safety selector for switching a firearm between at least two firing modes. The safety selector includes a cavity for placing a vial of tritium to provide a visual indication of the selected firing mode. A lock member extends through a portion of the firearm to regulate movement of a firing mechanism. A lever arm and a faceplate are connected to one end of the lock member to rotate the lock member between positions and an endcap is connected to the opposite end of the lock member to rotate therewith. At least one of the lever arm, the faceplate, and the endcap define the cavity for nesting the tritium vial. Another lever arm and faceplate may be located on the other side of the lock member for ambidextrous usage. The additional lever arm and/or faceplate may also include a cavity for nesting another tritium vial.

20 Claims, 15 Drawing Sheets

(56) References Cited

U.S. PATENT DOCUMENTS

| | | | | |
|---|---|---|---|---|
| 2016/0091268 | A1* | 3/2016 | Miller, III | F41A 17/46<br>42/70.06 |
| 2017/0246749 | A1 | 8/2017 | Karchon et al. | |
| 2017/0328663 | A1* | 11/2017 | Fellows | F41A 19/44 |
| 2017/0350666 | A1* | 12/2017 | Stamper | F41A 9/65 |
| 2018/0053575 | A1 | 2/2018 | Karchon et al. | |
| 2019/0063857 | A1* | 2/2019 | Garner | F41A 9/83 |
| 2020/0116448 | A1* | 4/2020 | Zung | F41A 17/74 |

* cited by examiner

TRITIUM FIREARM SAFETY SELECTOR

CROSS-REFERENCE TO RELATED APPLICATIONS

This U.S. utility application claims priority to and the benefit of U.S. provisional patent application Ser. No. 62/767,645 filed on Nov. 15, 2018, U.S. provisional patent application Ser. No. 62/825,109 filed on Mar. 28, 2019, and U.S. provisional patent application Ser. No. 62/836,876 filed on Apr. 22, 2019, the entire disclosures of which are hereby incorporated by reference.

BACKGROUND OF THE INVENTION

1. Field of the Invention

The present disclosure relates generally to a firearm safety selector that incorporates illumination for visibility during low to no-light conditions. More specifically, the present disclosure relates to a firearm safety selector, which encapsulates and protects a glass vial of the radioactive isotope tritium.

2. Related Art

This section provides a general summary of background information and the comments and examples provided in this section are not necessarily prior art to the present disclosure.

Tritium is a radioactive isotope of hydrogen which can be used as a luminary device for watches, compasses, knives, guns, tools, and the like. Naturally occurring tritium is extremely rare and thus too small for practical recovery. Accordingly, tritium is typically only produced in nuclear reactors and provided or retained within glass vials. However, the use of tritium in products, such as watches, compasses, knives, guns, tools, and the like, is closely regulated by various U.S. governmental organizations to protect the health and safety of the public and the environment. Toward that end, the use and incorporation of the tritium glass vials into said products is closely regulated by the federal government and any such use must sufficiently establish that the tritium vials are adequately protected from damage or breakage during their regular and everyday use. Absent such proof, the use and incorporation of tritium glass vials into said products is simply not permitted by the various U.S. governmental organizations.

SUMMARY OF THE INVENTION

In accordance with an aspect, the subject disclosure is directed to a safety selector for a firearm, which incorporates tritium in accordance with requisite regulatory requirements to provide illumination of the firearm safety selector for visibility during low to no-light conditions. The safety selector comprises a lock member extending along an axis A from a first end to a second end. A faceplate is secured to the first end of the lock member and a lever arm extends radially from the faceplate to a radial end for allowing a user to rotate the lock member about the axis A and interchange the firearm between a plurality of firing modes. At least one of the faceplate, the lever arm, or the second end define a cavity. A tritium vial is disposed within the cavity to provide an indication of the firing mode that is visible in nighttime and low quality of ambient light conditions of the firearm.

These and other advantages of the incorporation of tritium vials into a firearm safety selector will be appreciated in view of the following more detailed description of the subject invention.

BRIEF DESCRIPTION OF THE DRAWINGS

The drawings described herein are for illustrative purposes only of selected embodiments and not all possible implementations, and are not intended to limit the scope of the present disclosure.

DETAILED DESCRIPTION OF THE ENABLING EMBODIMENTS

Example embodiments of a tritium firearm safety selector in accordance with the present disclosure will now be more fully described. Each of these example embodiments are provided so that this disclosure is thorough and fully conveys the scope of the inventive concepts, features and advantages to those skilled in the art. To this end, numerous specific details are set forth such as examples of specific components, devices and mechanisms associated with the tritium firearm safety switch to provide a thorough understanding of each of the embodiments associated with the present disclosure. However, as will be apparent to those skilled in the art, not all specific details described herein need to be employed, the example embodiments may be embodied in many different forms, and thus should not be construed or interpreted to limit the scope of the disclosure.

Figure 1:
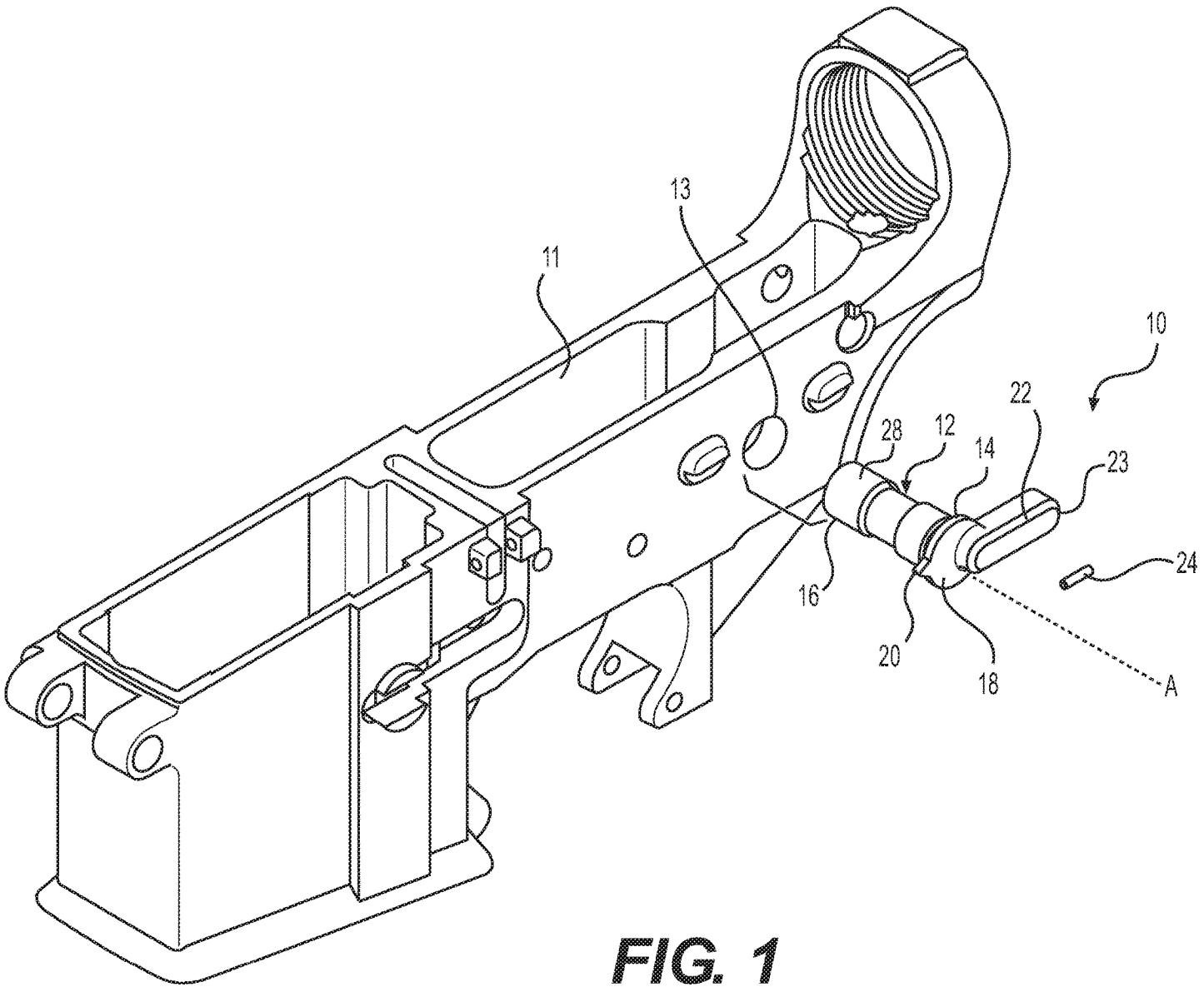
FIG. 1 is an exploded perspective view illustrating a firearm safety selector for insertion into a lower receiver of a firearm and a glass vial of tritium that can be connected to the safety selector to indicate two or more firing modes of the firearm.

The various embodiments of the safety selector 10 presented throughout the Figures are capable of reliably indicating a firing mode of a firearm in various lighting conditions. Referring initially to FIG. 1, a firearm safety selector 10 is generally shown for insertion into a lower receiver 11 of a firearm. More particularly, the receiver 11 includes an aperture 13 in which the various embodiments of the safety selector 10 can be placed. As will be described in further detail below, the safety selector 10 may be configured to be removeably attached to the aperture 13, such that it can be periodically removed to be cleaned, replaced, or otherwise inspected. Because the embodiments herein utilize the incorporation of tritium into glass vials, for example, periodic inspection of the vials may be necessary to make sure the vials are still operational and safe for use.

With continued reference to FIG. 1, many of the embodiments of the safety selector 10 described herein include a lock member 12 extending along an axis A from a first end 14 to a second end 16. As is well known in the art, when the safety selector 10 is mounted within a firearm (e.g., the aperture 13), the lock member 12 is rotatable about the axis A by a user to establish different firing modes of the firearm. The lock member 12 may include a flat cam surface 15 (as best illustrated in FIGS. 9A through 13C) for actuating a portion of the firearm's firing mechanism between fire modes upon rotation. For example, the lock member 12 could be rotatable between a "SAFE" position, in which the lock member 12 blocks movement of a portion of the firearm's firing mechanism (not shown) to prevent firing, and a "FIRE" position, which allows the portion of the firing mechanism to effectuate firing. The lock member 12 could also be rotatable to establish and indicate other firing modes, such as a "SINGLE FIRE", "BURST FIRE", or "AUTOMATIC" modes.

In any arrangement of the lock member 12, it is important to quickly identify what firing mode is selected. Accordingly, several embodiments of the firearm safety selector 10 include a faceplate 18 secured to either the first end 14 and/or the second end 16 of the lock member 12 to rotate therewith. In addition, many arrangements include an end cap 28 secured on an opposite end from the faceplate 18. In some arrangements, the faceplate 18 is circular in shape and includes a pointer 20 extending radially from the faceplate 18 to provide a visual indication of the position of the lock member 12, i.e., the selected firing mode. The pointer 20 may be coated with a colored, phosphorescent, or other suitable material to highlight a current position of the pointer 20 in various environmental conditions, such as low light. Several embodiments of the firearm safety selector 10 that will be described herein also include a lever arm 22 secured to and extending radially from the faceplate 18 to a radial end 23 disposed in opposing and aligned relationship with the pointer 20. The lever arm 22 may thus be utilized by a user to rotate the lock member 12 between the various firing modes with a thumb or finger without having to move from a firing stance. Additionally, since the lever arm 22 is disposed in recognizable relationship with respect to the pointer 20, the lever arm 22 also functions to indicate and emphasize a firing mode both visually and tactilely. The faceplate 18 may be integral with the first end 14, the lever arm 22, both, or neither.

In addition to the lever arm 22 and the pointer 20, the firearm safety selectors 10 described herein incorporate a tritium vial 24 containing tritium 17 (e.g., FIG. 2) into its components to enhance and improve the performance of the firearm safety selector 10 in nighttime or low quality of ambient light conditions. The tritium vial 24 may be used in conjunction with the pointer 20 that is coated or not coated. As will be described in greater detail below, the tritium vial 24 may be formed of glass or plastic and incorporated into one or more of the faceplate 18, the lever arm 22, the lock member 12, and the end cap 28. The incorporation of the tritium vial 24 advantageously allows a user to easily and readily identify a firing mode of the firearm in all possible conditions. Tritium relies on radioactivity to provide illumination and thus it advantageously does not require any external power source, has a relatively long half-life (tritium has a half-life of 12.3 years), and provides an adequate amount of brightness without being too bright to alarm nearby persons. In accordance with one aspect of the disclosure, the firearm safety selector 10 thus improves upon the prior art firearm safety selectors that require various power inputs to provide illumination that are thus subject to failure or sudden dimming.

Figure 2:
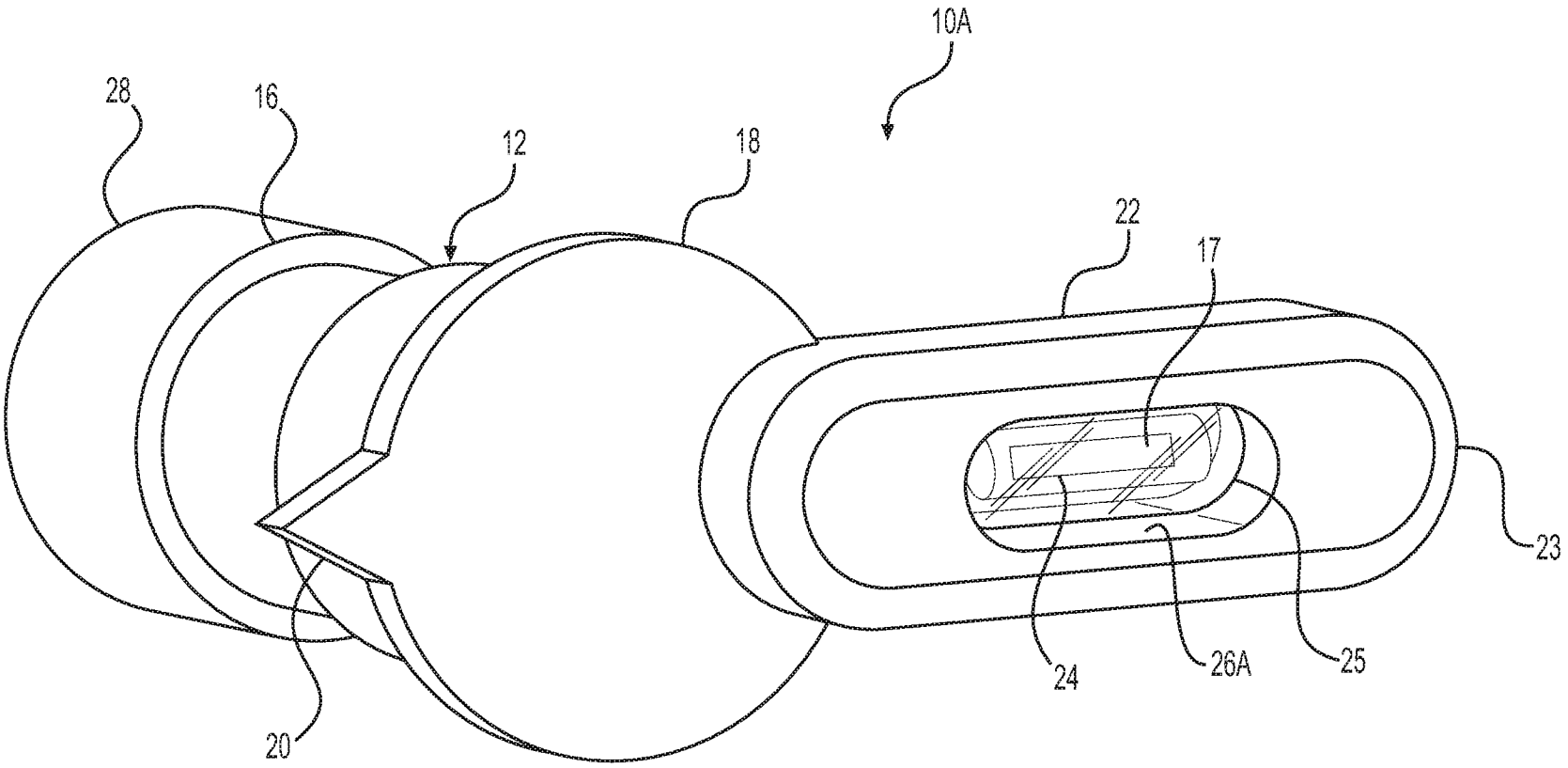
FIG. 2 is a perspective view of a first embodiment of the firearm safety selector illustrating a lever arm defining a cavity for receiving and protecting the tritium vial.

As best illustrated in FIG. 2, a first embodiment of the firearm safety selector 10A is generally shown and includes the lever arm 22 defining a cavity 26A extending longitudinally in parallel and aligned relationship with the lever arm 22. The tritium vial 24 containing tritium 17 is disposed and secured within the cavity 26A, such as through an adhesive or the like to nest or protect the tritium vial 24 within the interior body of the firearm safety selector 10A to meet the strict federal government regulations. A viewing window 25 may be disposed on or near the outside of the cavity 26A for covering and further protecting the tritium vial 24. The viewing window 25 is designed in a way that the user is able to view the tritium vial 24 while it is nested and protected from breaking. The tritium vial 24 is disposed in aligned relationship with both the pointer 20 and the lever arm 22, and thus readily provides an indication of the firing mode of the firearm in nighttime or low quality of light ambient conditions.

Figure 3:
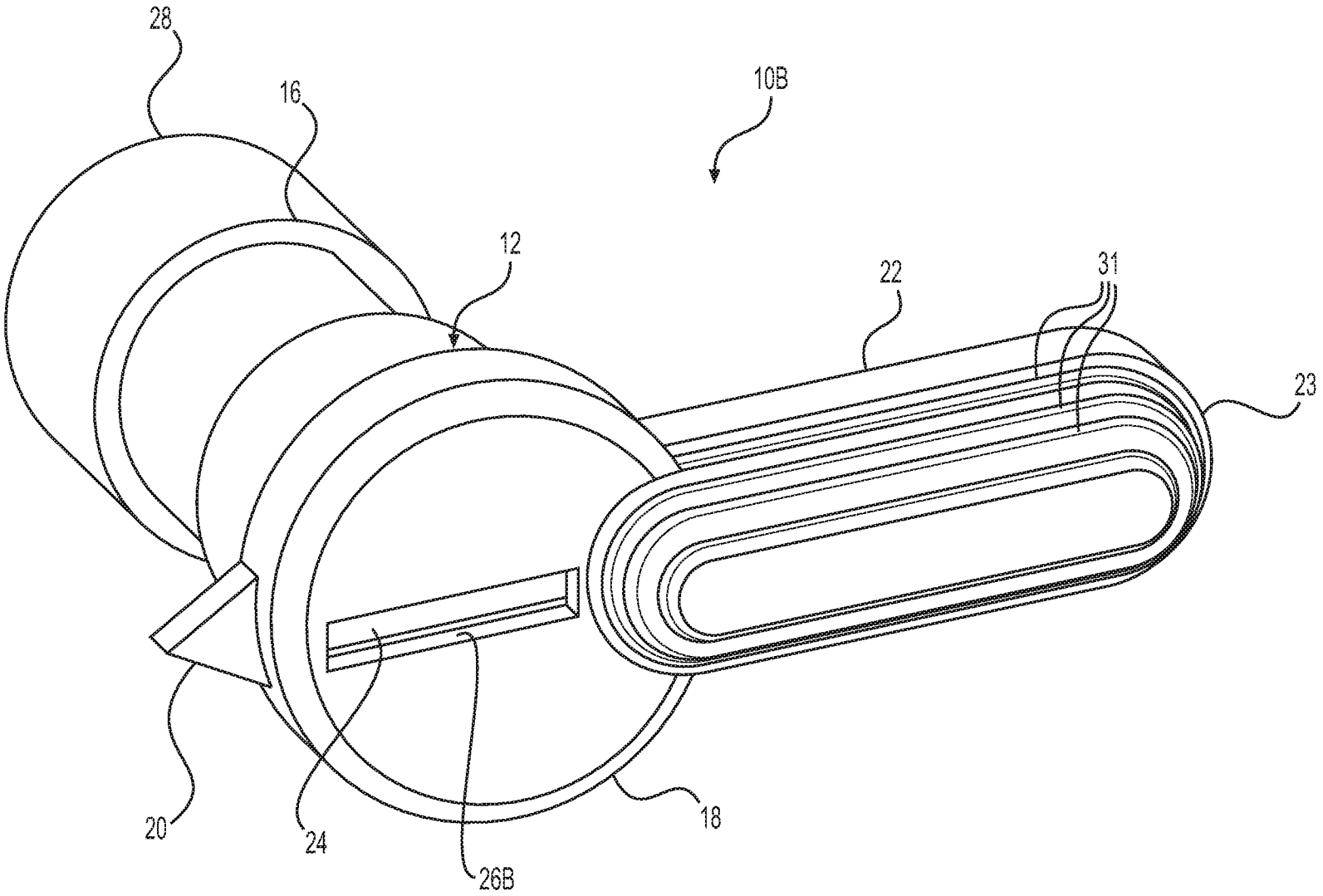
FIG. 3 is a perspective view of a second embodiment of the firearm safety selector illustrating a faceplate defining the cavity for receiving and protecting the tritium vial.

A second embodiment of the firearm safety selector 10B is generally shown in FIG. 3. The first and second embodiments are similar, however, in the second embodiment the faceplate 18 defines the cavity 26B, which extends longitudinally in an aligned relationship with the pointer 20. The tritium vial 24 containing tritium 17 is disposed and secured within the cavity 26B, such as through an adhesive or the like to nest or protect the tritium vial 24 within the interior body of the firearm safety selector 10B to meet the strict federal government regulations. The firearm safety selector 10B may also include a viewing window disposed on or near the outside of the cavity 26B for covering and further protecting the tritium vial 24. The tritium vial 24 is disposed in aligned relationship with both the pointer 20 and the lever arm 22, and thus readily provides an indication of the firing mode of the firearm in nighttime or low quality of light ambient conditions. The lever arm 22 defines a plurality of steps 31 for increasing the grip and improving control during operation. It should be appreciated that steps 31 can be included in the other embodiments.

Figure 4:
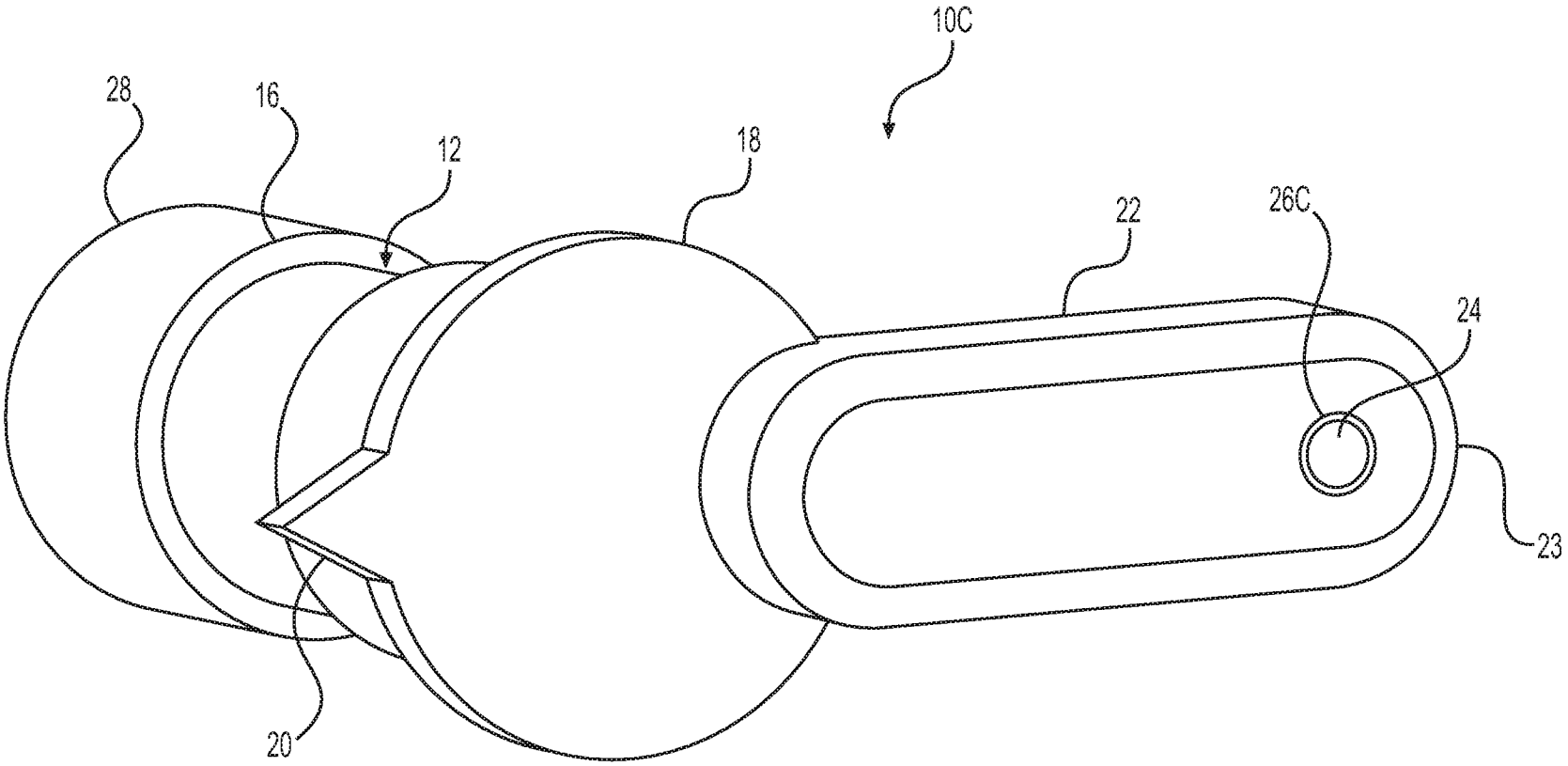
FIG. 4 is a perspective view of a third embodiment of the firearm safety selector illustrating the cavity extending axially into the lever arm and disposed in adjacent relationship with a radial end of the lever arm.

A third embodiment of the firearm safety selector 10C is generally illustrated in FIG. 4 and includes the cavity 26C extending axially into the lever arm 22 —instead of radially or longitudinally along these components —for further nesting and protecting the tritium vial 24. More particularly, the cavity 26C extends axially into the lever arm 22 and is disposed adjacent the radial end 23, such that the visible portion is not elongated, e.g., the visible portion may be circular. As with the previous embodiments, the tritium vial 24 is nested and protected within the lever arm 22, with only an end of the tritium vial 24 being visible by the user to provide an indication of the firing mode of the firearm in nighttime or low quality of light ambient conditions. As such, the end of the tritium vial 24 provides an indication of the firing mode, while the rest of the tritium vial 24 is encapsulated by and protected by the respective components. The firearm safety selector 10C may also include a viewing window disposed on or near the outside of the cavity 26C for covering and further protecting the tritium vial 24. The tritium vial 24 includes a shape that is less elongated than in the previous embodiments.

Figure 5:
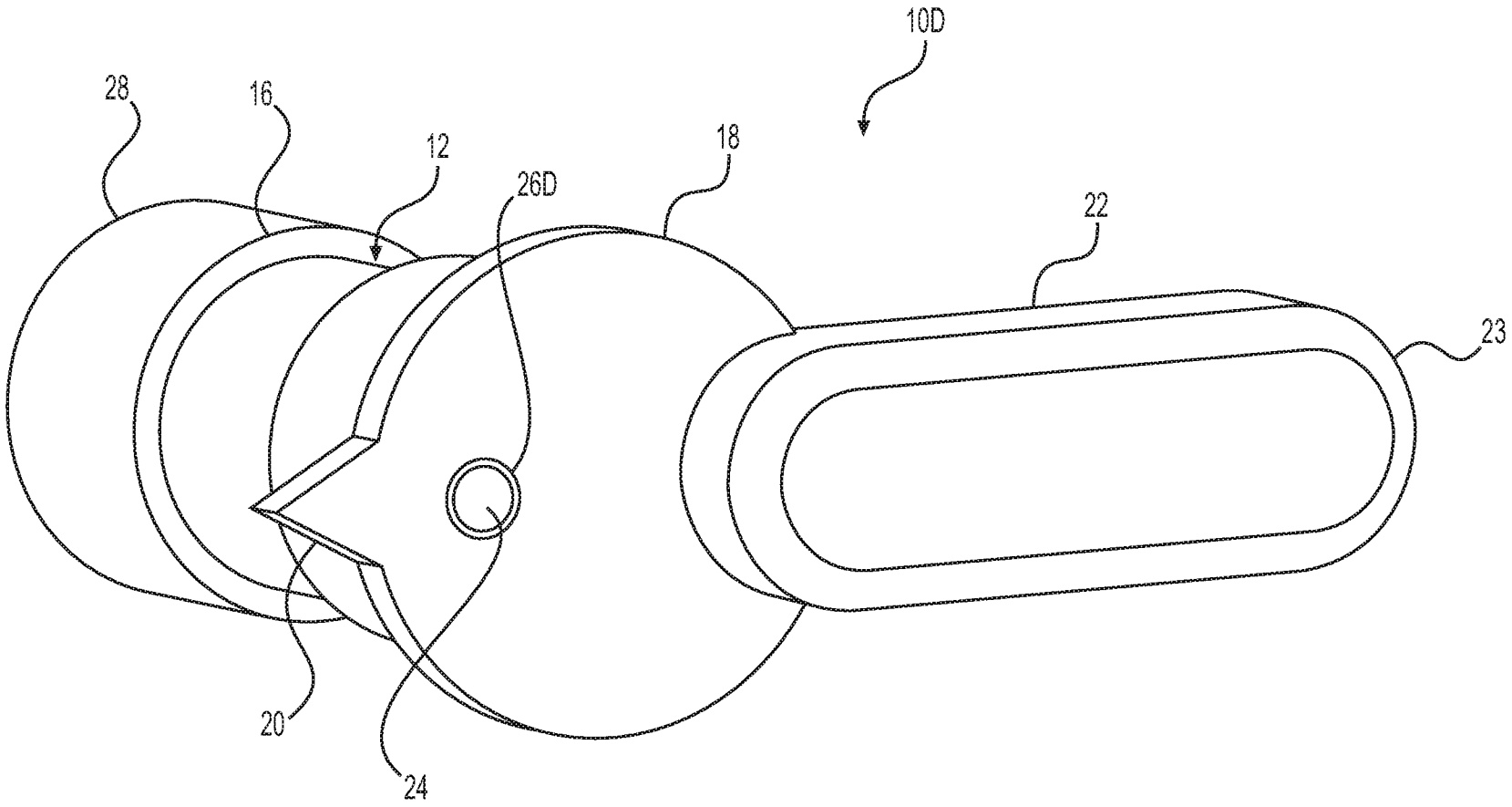
FIG. 5 is a perspective view of a fourth embodiment of the firearm safety selector illustrating the cavity extending axially into the faceplate and disposed adjacent a pointer.

A fourth embodiment of the firearm safety selector 10D is generally illustrated in FIG. 5 and includes the cavity 26D extending axially into the faceplate 18 —instead of radially or longitudinally along these components —for further nesting and protecting the tritium vial 24. More particularly, the cavity 26D extends axially into the faceplate 18 (and in some instances partially into the lock member 12) and is disposed adjacent the pointer 20, such that the visible portion is not elongated, e.g., the visible portion may be circular. Similar to the previous embodiments, the tritium vial 24 is nested and protected within the faceplate 18, with only an end of the tritium vial 24 being visible by the user to provide an indication of the firing mode of the firearm in nighttime or low quality of light ambient conditions. As such, the end of the tritium vial 24 provides an indication of the firing mode, while the rest of the tritium vial 24 is encapsulated by and protected by the respective components. The firearm safety selector 10D may also include a viewing window disposed on or near the outside of the cavity 26D for covering and further protecting the tritium vial 24.

Figure 6:
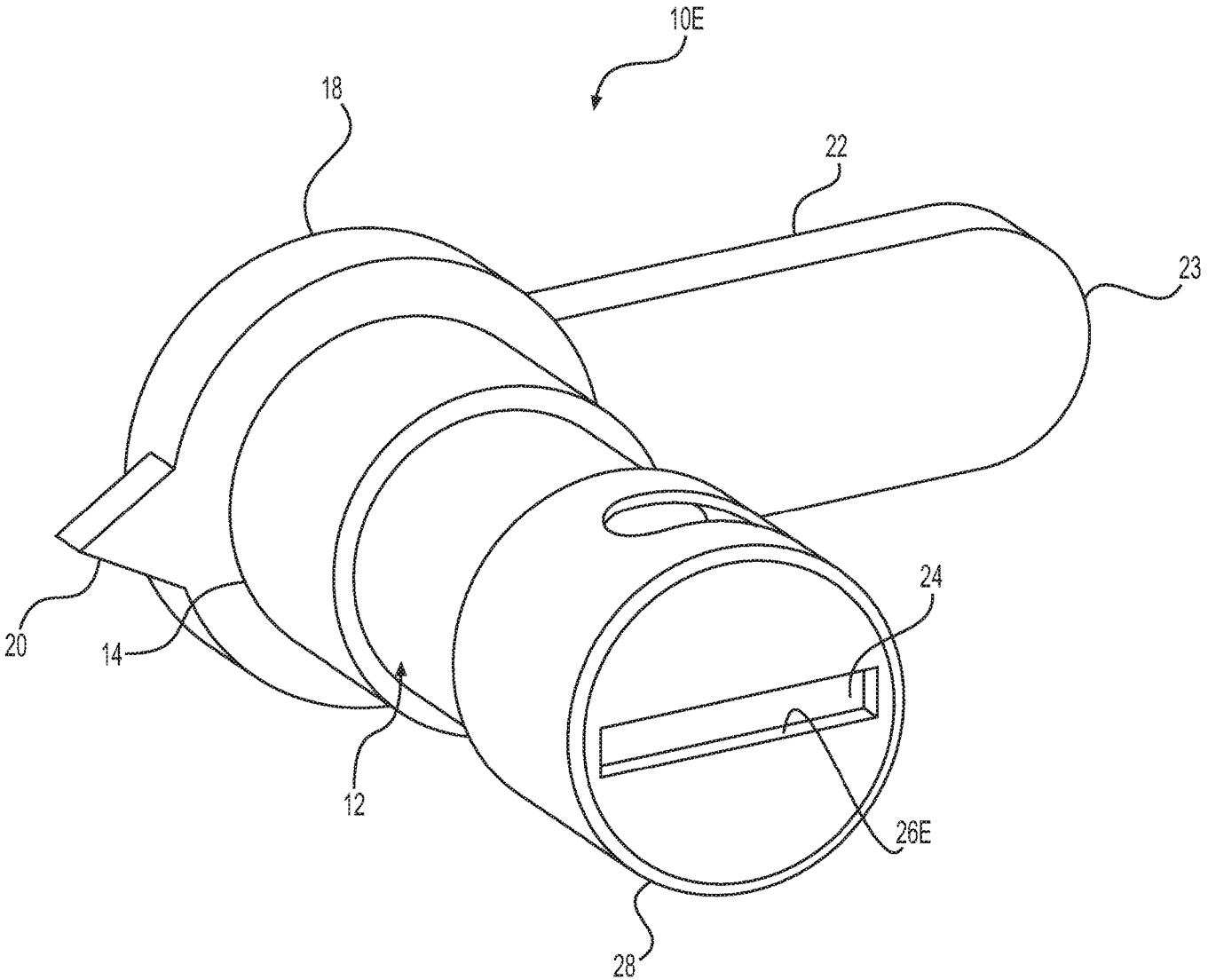
FIG. 6 is a perspective view of a fifth embodiment of the firearm safety selector illustrating an end cap of a lock member defining the cavity for receiving and protecting the tritium vial.

A fifth embodiment of the firearm safety selector 10E is generally illustrated in FIG. 6 and includes features which may be used in conjunction with the other described embodiments with a cavity 26 and a vial 24 within the faceplate 18 and/or lever arm 22. More particularly, in the fifth embodiment, the end cap 28 is attached to the second end 16 of the lock member 12 which includes the cavity 26E extending in a longitudinally aligned relationship with the lever 22. Of note, when the firearm safety selector 10E is secured to the firearm, the faceplate 18 and lever arm 22 are disposed on one side of the firearm, and the end cap 28 is disposed on the opposite side of the firearm. As such, the pointer 20 and lever arm 22 can only indicate a firing mode of the firearm on one side. To overcome this shortcoming, the end cap 28 of the fifth embodiment defines the cavity 26E for receiving the tritium vial 24 to advantageously provide a visible indication of the firing mode on the other side of the firearm. Additionally, in certain situations it may be advantageous that the end cap 28 is used in conjunction with the other embodiments that provide a tritium vial 24 in the faceplate 18 and/or lever arm 22 to provide an indication of the firing mode on both sides of the firearm. Accordingly, more than one cavity 26 and tritium vial 24 may be present in certain embodiments. The firearm safety selector 10E may also include a viewing window disposed on or near the outside of the cavity 26E for covering and further protecting the tritium vial 24.

Figure 7:
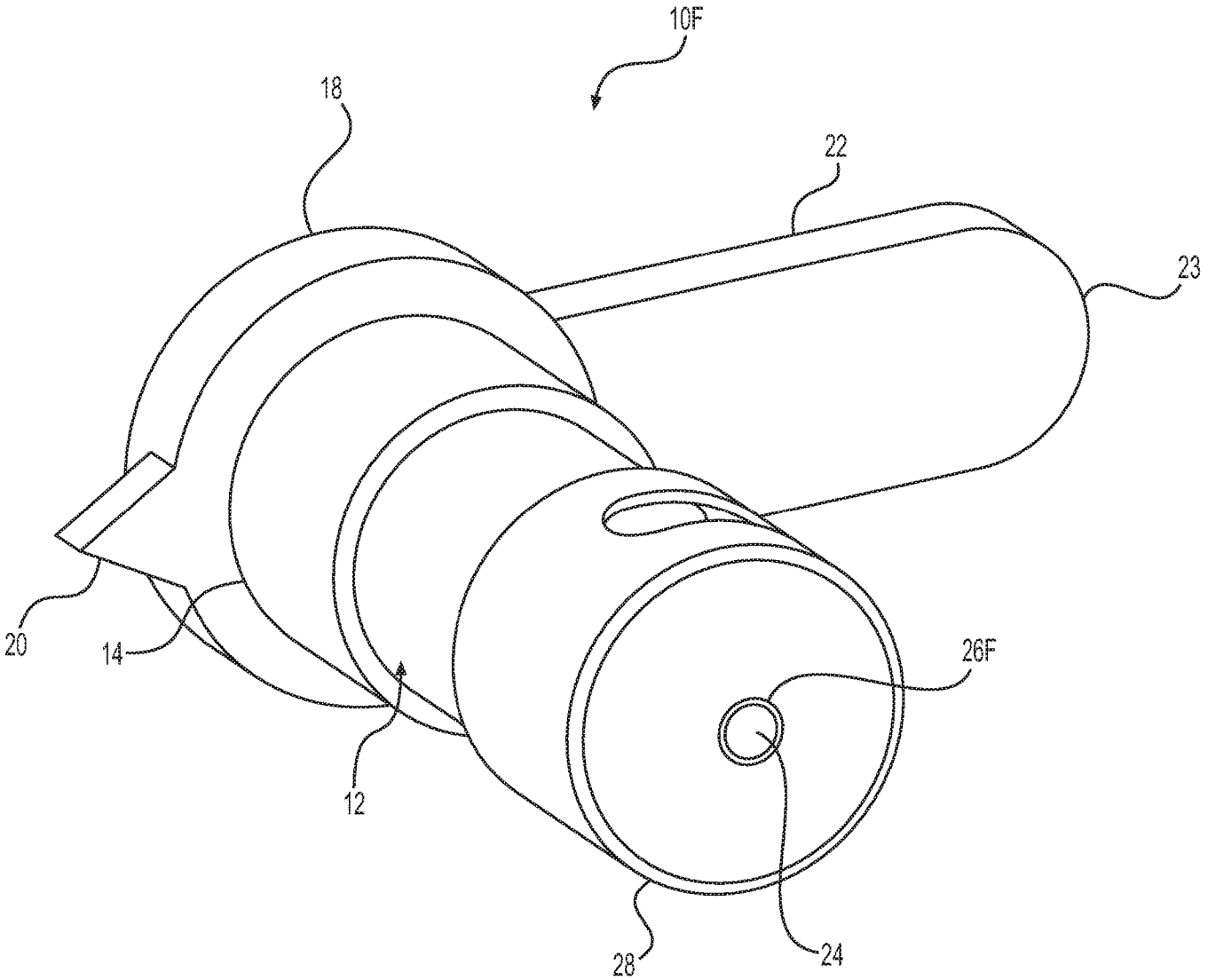
FIG. 7 is a perspective view of a sixth embodiment of the firearm safety selector illustrating the cavity extending axially into a center of the end cap.

A sixth embodiment of the firearm safety selector 10F is generally illustrated in FIG. 7 and includes another arrangement of an end cap 28 at least partially enclosing a tritium vial 24. More particularly, the end cap 28 is similar to that presented in the fifth embodiment shown in FIG. 6 but the cavity 26F is axially aligned with the locking member 12 such that the visible portion of the tritium vial 24 is not elongated, e.g., the visible portion may be circular. The firearm safety selector 10F may also include a viewing window disposed on or near the outside of the cavity 26F for covering and further protecting the tritium vial 24.

Figure 8:
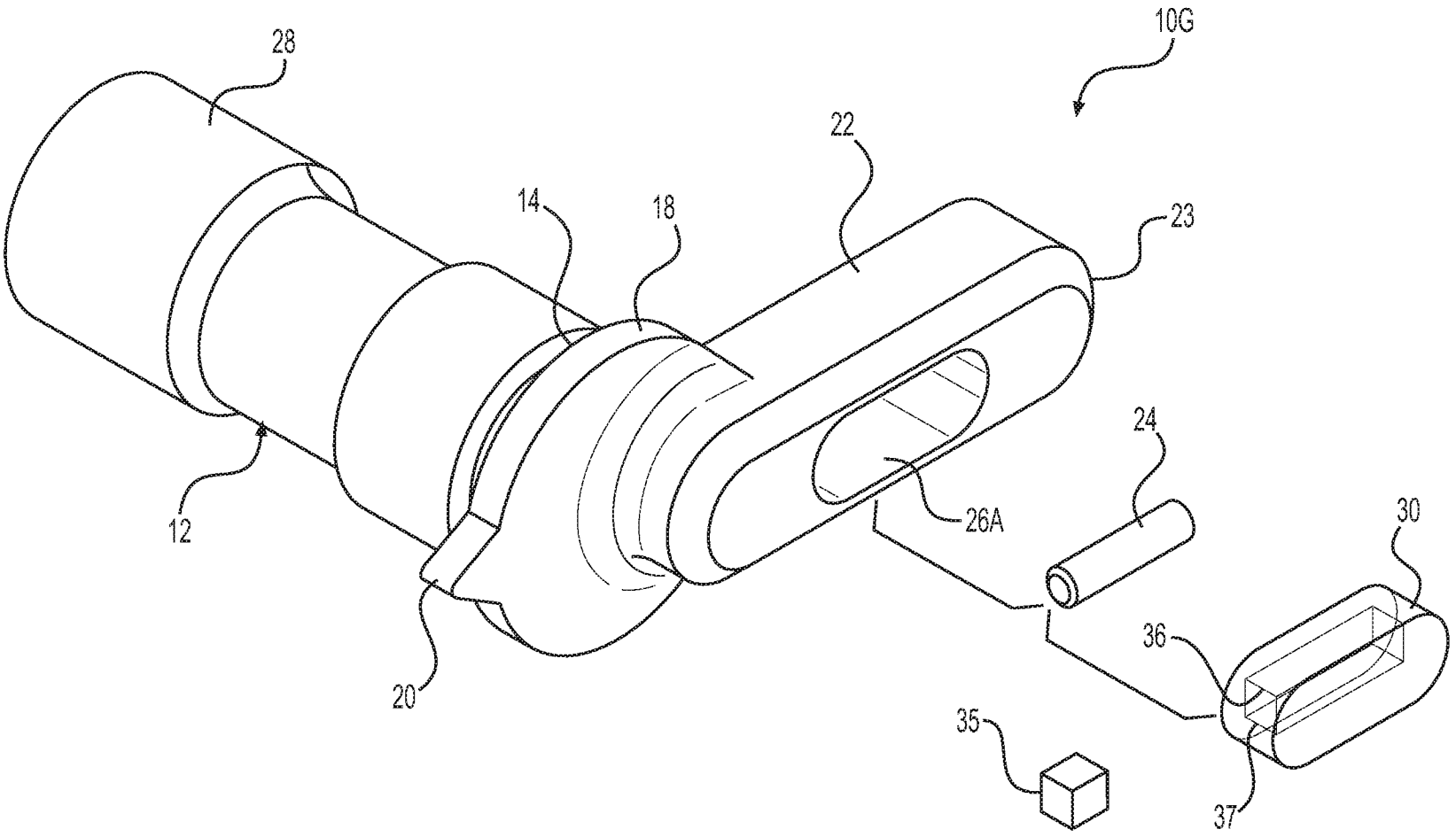
FIG. 8 is an exploded perspective view of a seventh embodiment of the firearm safety selector illustrating a tritium vial being placed within a casing.

A seventh embodiment of the firearm safety selector 10G is generally illustrated in FIG. 8 and includes the lever arm 22 defining a cavity 26 that extends longitudinally in parallel and aligned relationship with the lever arm 22 and the tritium vial 24 is disposed and secured within the cavity 26A. The seventh embodiment is similar to the first embodiment illustrated in FIG. 2 but the tritium vial 24 and/or the tritium 17 is at least partially enclosed by a casing 30 that is secured within the cavity 26A. As such, the glass vial of tritium 24 is nested or protected within the casing 30 to meet the strict federal government regulations that are required to incorporate tritium into the firearm safety selector 10G. The casing 30 may include a pocket 36 for housing the tritium vial 24. The pocket 36 may be fully surrounded by the casing 30 or the casing 30 may otherwise define an entry aperture 37 for placement of the tritium vial 24 once molded or otherwise formed. After insertion of the tritium vial 24 and/or tritium 17 into the entry aperture 37, the casing 30 may further include a cap 35 for covering the entry aperture 37. The cap 35 may comprise the same material as the casing 30 and be bonded together with the rest of the casing 30 via adhesive, heat sealing, fusing, press-fitting, clamping, fastening, molding, welding, or otherwise permanently connected upon mating. In one example, enough adhesive is used to completely encapsulate the tritium vial 24 and/or tritium 17. In another example, the tritium vial 24 and/or tritium 17 may be inserted in the casing 30 via methods described in U.S. Pat. No. 10,062,464, or its corresponding family member EP 3500816, each entitled a "Tritium Housing," and each of which are incorporated by reference herein. Placement of the tritium 17 within the vial 24 may be carried out in accordance with the same methodologies of the casing 30.

The casing 30 is preferably transparent such that the user is able to view the tritium vial 24 and/or tritium 17 and is solid enough so that the user cannot accidently puncture or break it. The casing 30 is preferably formed of glass or plastic; however, any transparent or translucent solids can be used without departing from the subject disclosure. The casing 30 may further include materials of various colors and may further include more than one color within a singular casing 30. The casing 30 may be cylindrical for allowing illumination from the tritium vial 24 and/or tritium 17 to be viewable from a wider range of angles, pill-shaped as shown in FIG. 8, or any other shape. In one embodiment, the casing 30 may be at least partially phosphorescent. As shown, the tritium vial 24 and/or tritium 17 is disposed within the casing 30 and the casing 30 is then fit within the cavity 26 and attached to the lever arm 22 such that the tritium vial 24 is in an aligned relationship with both the pointer 20 and the lever arm 22, and thus readily provides an indication of the firing mode of the firearm in nighttime or low quality of light ambient conditions. While the casing 30 is described with specific reference to the seventh embodiment, it should be appreciated that the casing 30 may be utilized in any of the other embodiments including locations on the end cap 28. Moreover, in addition to the casing 30, each embodiment may further or alternatively include a viewing window 25 (e.g., FIG. 2) separate from the casing 30. Similarly, the casing 30 and window 25 may be used with or without the vial 24, i.e., only with the tritium 17. Both the vial 24 and window 25 may be constructed with similar materials and colors as described above.

Figure 9A:
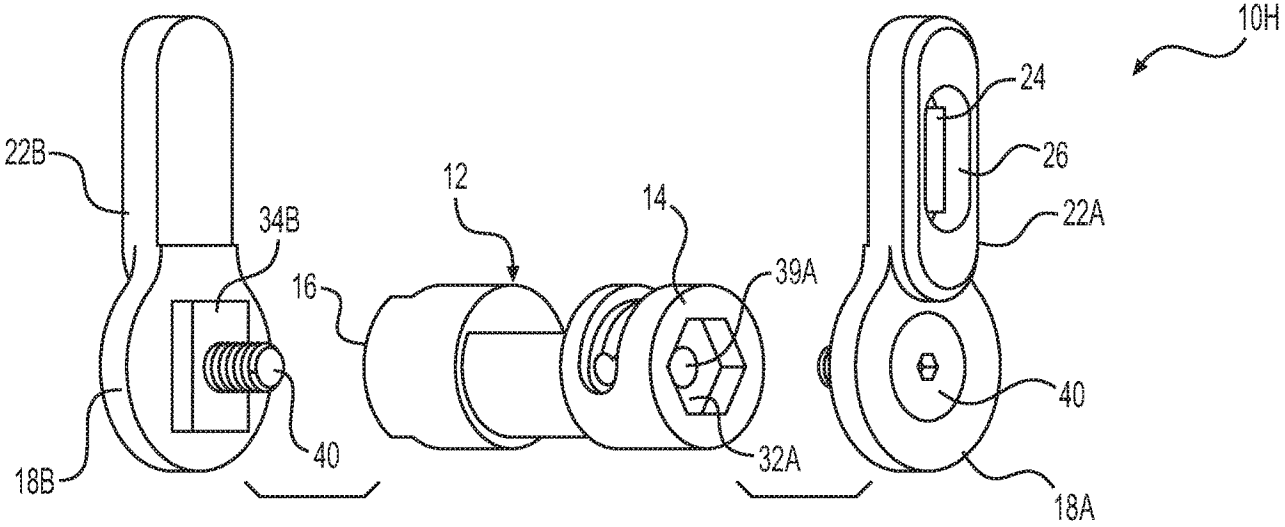
FIG. 9A is an exploded perspective view of an eighth embodiment of the safety selector having two lever arms for ambidextrous usage of the safety selector.
Figure 9B:
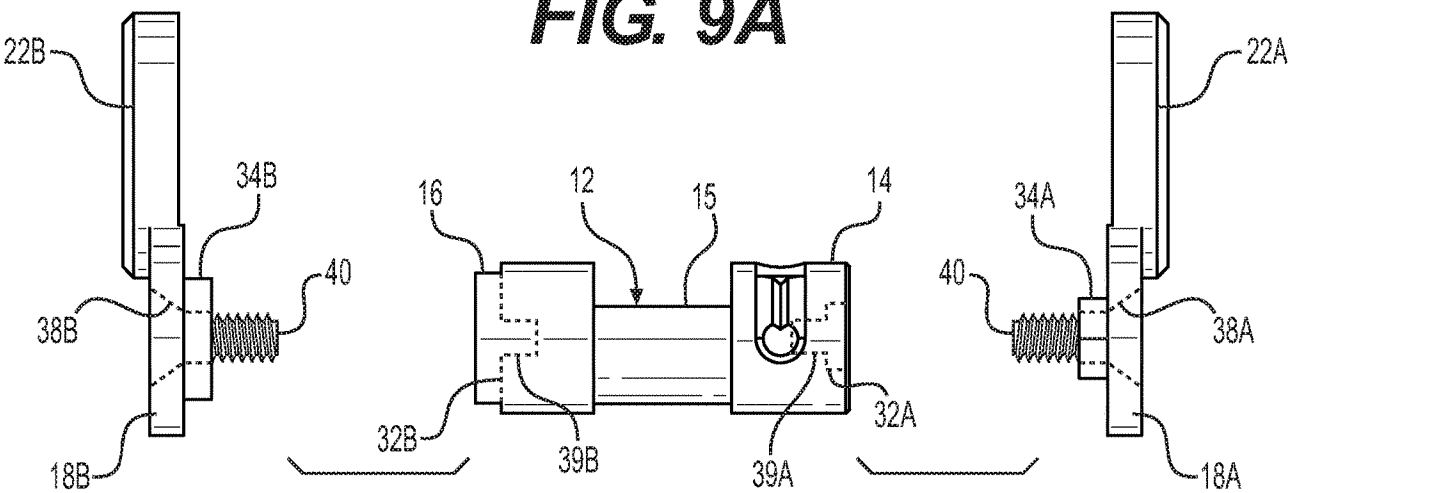
FIG. 9B is an exploded side view of the eighth embodiment of the safety selector illustrated in FIG. 9A.
Figure 9C:
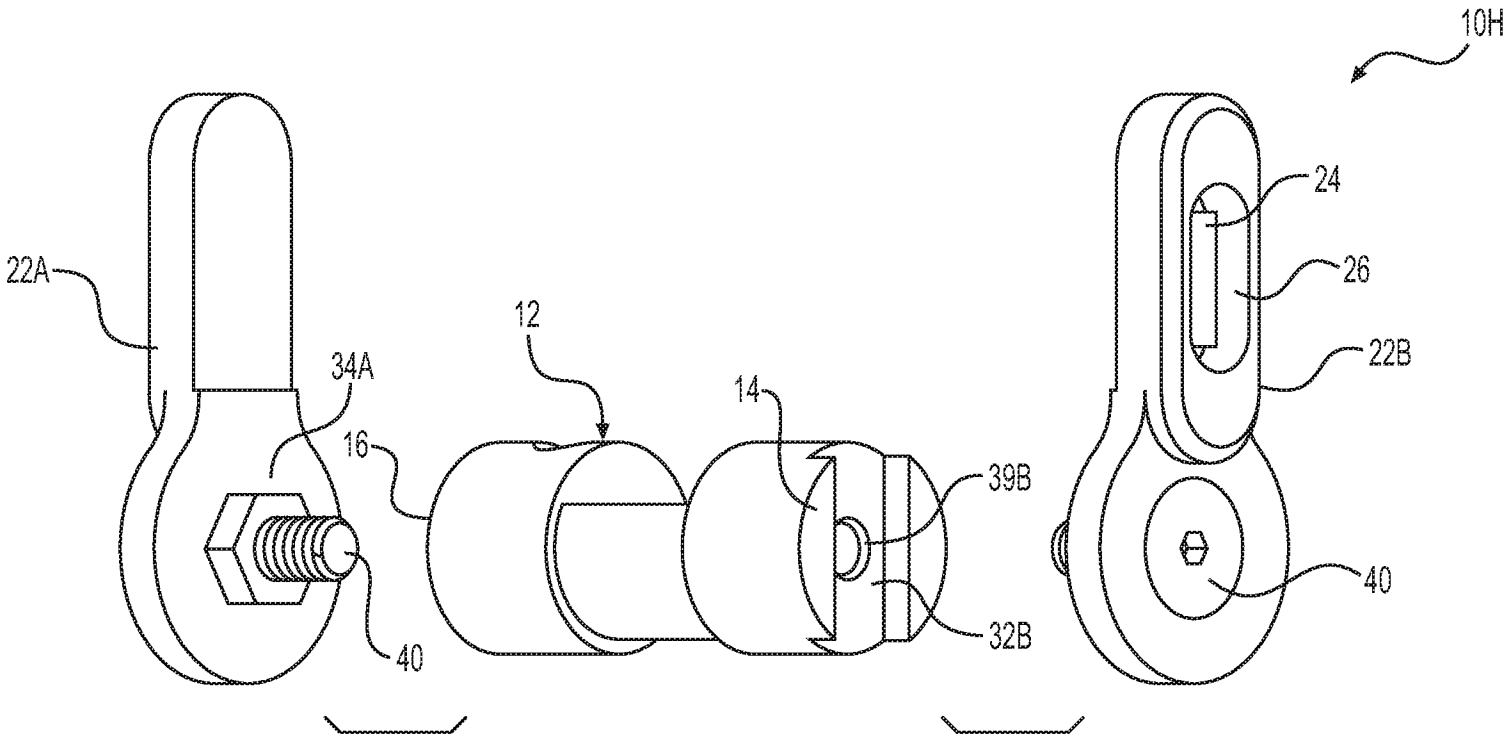
FIG. 9C is another exploded perspective view of the eighth embodiment of the safety selector having two lever arms for ambidextrous usage illustrating a different arrangement of mating a lock member with the two lever arms.

An eighth embodiment of the firearm safety selector 10H is generally shown in FIGS. 9A through 9C and provides ambidextrous functionality. More particularly, the safety selector 10H includes a first lever arm 22A having a first faceplate 18A on the first end 14 and a second lever arm 22B on the second end 16. The first end 14 of the lock member 12 includes a first depression 32A that is sized to receive a correspondingly shaped protrusion 34A on the first faceplate 18A. A first connection aperture 39A is located within the first depression 32A and a first faceplate aperture 38A is located in the first faceplate 18A that extends to the first protrusion 34A. A screw 40 is sized to fit through first faceplate aperture 38A and into first depression 32A to draw the first protrusion 34A into the first depression 32A. Similar to the first end 14, the second end 16 includes a second depression 32B that is sized to receive a correspondingly shaped protrusion 34B on the second faceplate 18B. A second connection aperture 39B is located within the second depression 32B and a second faceplate aperture 38B is located in the second faceplate 18B that extends through the second protrusion 34B. Another screw 40 is sized to fit through the second faceplate aperture 38B and into the second depression 32B to draw the second protrusion 34B into the second depression 32B. As best illustrated in FIG. 9B, each faceplate aperture 38 has a tapered counterbore such that a fastener head of the fastener 40 is flush against the respective faceplate 18 surface. The previous described flat cam surface 15 can be seen in FIG. 9B.

Figure 10:
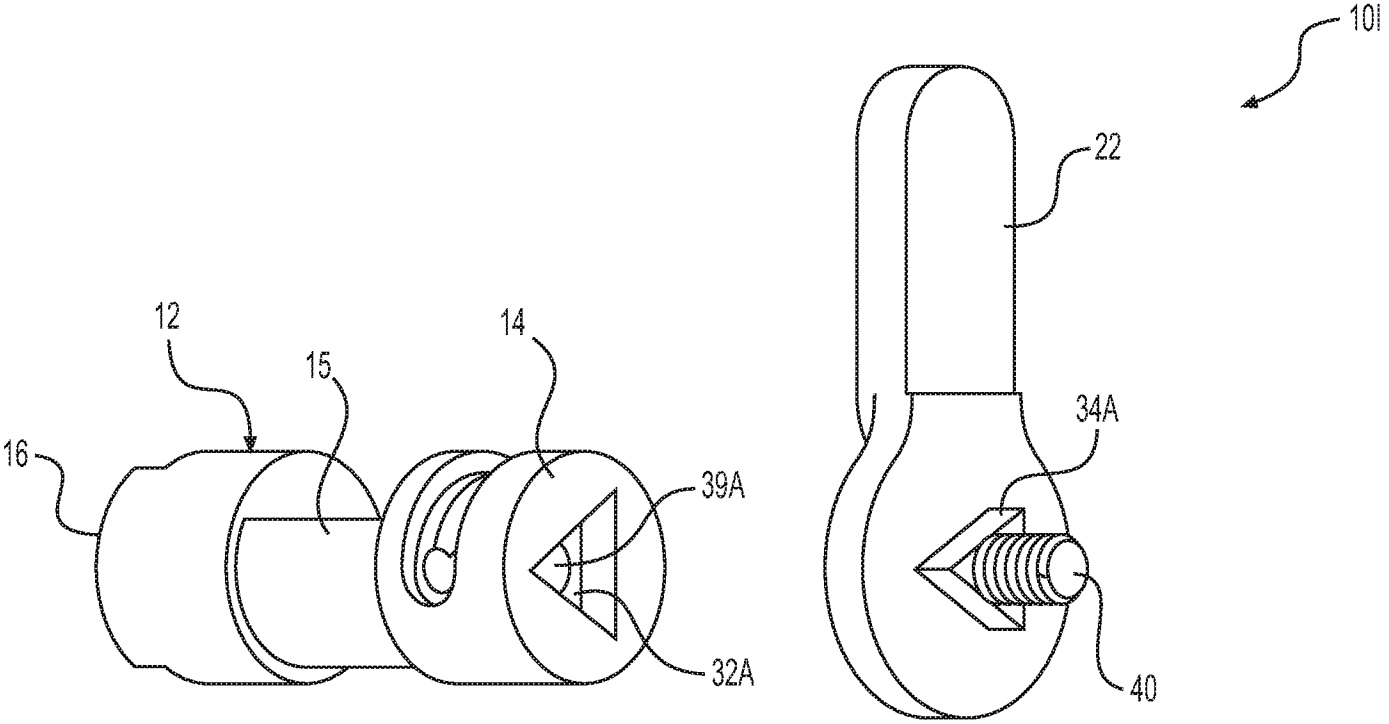
FIG. 10 is an exploded view of a ninth embodiment of the safety selector illustrating an alternative mating relationship between the lock member and the lever arm.
Figure 11:
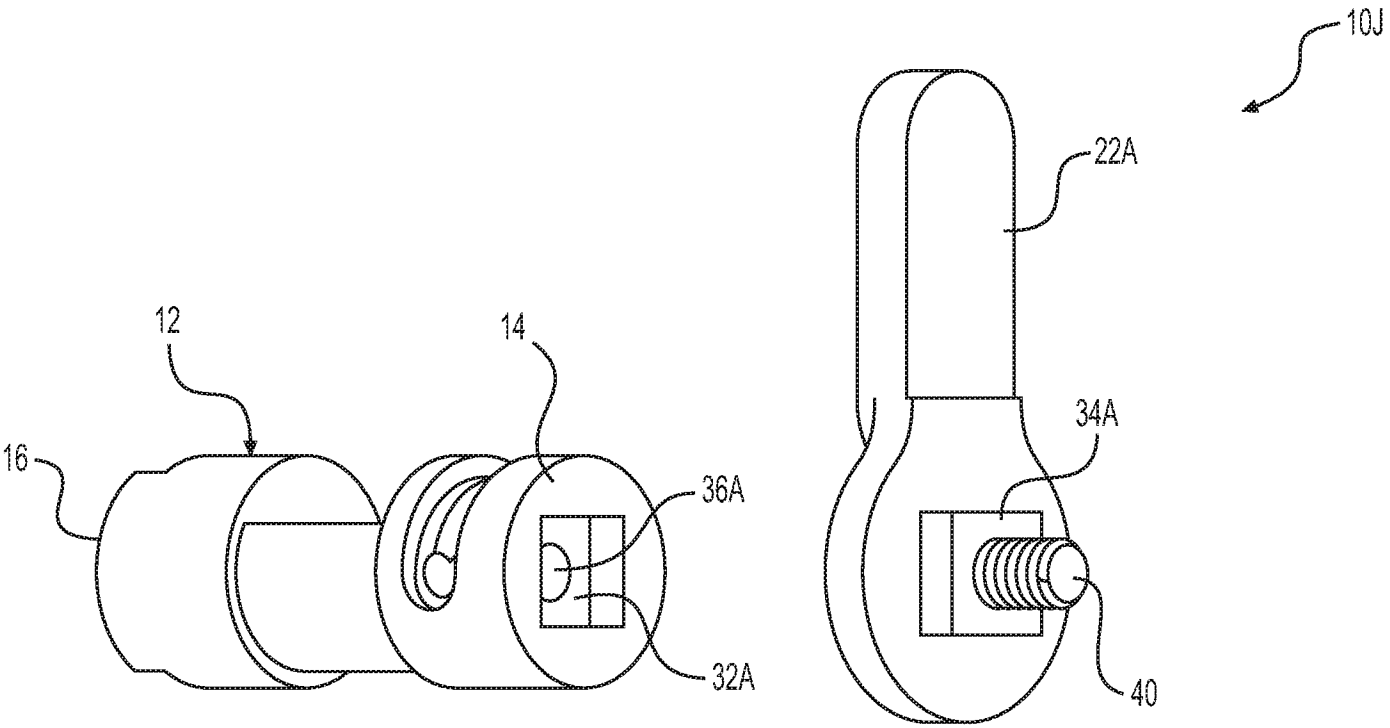
FIG. 11 is an exploded view of a tenth embodiment of the safety selector illustrating yet another alternative mating relationship between the lock member and the lever arm.

The numerous depressions 32 and correspondingly shaped protrusions 34 described herein can have numerous different shapes and combinations of shapes to assist in translating rotational movement of the lever arm 22 into the lock member 12. In accordance with the most preferred aspect, the depression 32 and correspondingly shaped protrusion 34 on one end of the lock member 12 are different than the depression 32 and correspondingly shaped protrusion 34 on the other end of the lock member 12. As such, the levers 22 and faceplates 18 can only be connected to a specific end of the lock member 12 and are not interchangeable. Now referring back to the eighth embodiment, in one arrangement the first depression 32A and first protrusion 34A are hexagonally shaped and the second depression 32B and second protrusion 34B are rectangular shaped. A ninth embodiment of the safety selector 10I is generally shown in FIG. 10 and in this arrangement the first depression 32A and first protrusion 34A are triangularly shaped and the second depression 32B and second protrusion 34B are rectangular shaped. A tenth embodiment of the safety selector 10J is generally shown in FIG. 11 and in this arrangement the first depression 32A and first protrusion 34A are square shaped and the second depression 32B and second protrusion 34B being rectangular shaped. In other embodiments, one pair of depressions 32 and protrusions 34 may be one of rectangular, square, hexagonal, triangular or other shapes while the other pair of depressions 32 and protrusions 34 may be a different one of rectangular, square, hexagonal, triangular or other shapes. Additionally, in other embodiments, one of the paired depression 32 and protrusion 34 may be hexagonally shaped while the other paired depressions 32 and protrusion 34 is one of a square, triangle or other shapes. In accordance with another aspect, the one of pair of depression 32 and protrusion 34 may be triangular shaped while the other pair of depression 32 and protrusion 34 is one of a square, hexagonal, or other shapes. In accordance with yet another aspect, the one of the pair of depression 32 and protrusion 34 may be square while the other pair of depression 32 and protrusion 34 is one of a triangular, hexagonal, or other shapes.

Figure 12C:
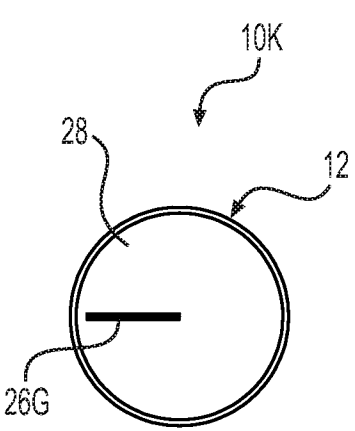
FIG. 12C is an end view of the eleventh embodiment of the safety selector illustrated in FIG. 12A.
Figure 12B:
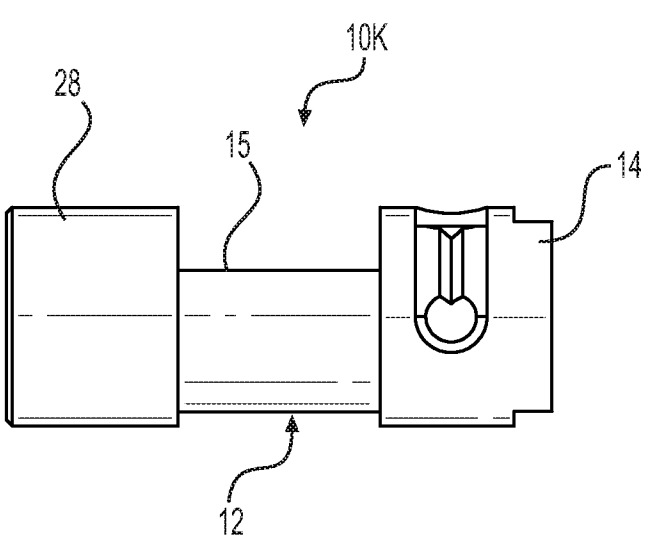
FIG. 12B is a side view of the eleventh embodiment of the safety selector illustrated in FIG. 12A.
Figure 12A:
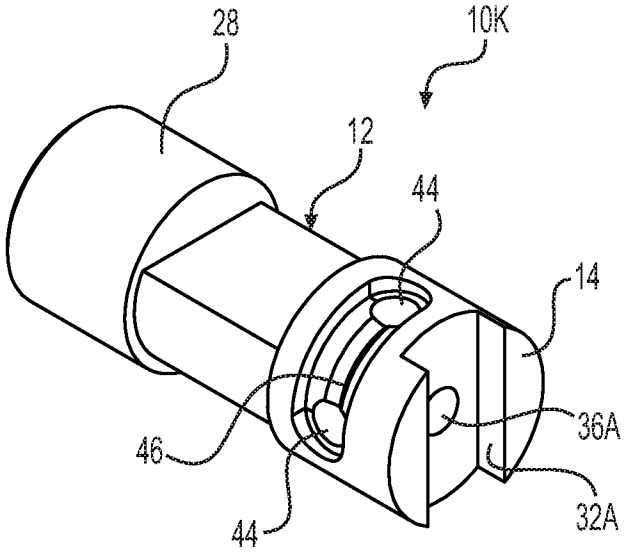
FIG. 12A is a perspective view of an eleventh embodiment of the safety selector illustrating the end cap defining the cavity for receiving and protecting the tritium vial.

An eleventh embodiment of the firearm safety selector 10K is generally shown in FIGS. 12A through 12C and includes the lock member 12 having a depression 32A of a rectangular shape located on the first end 14 for receiving correspondingly shaped protrusion 34, similar to that shown in FIG. 9A. However, the second end 16 of the lock member 12 includes an endcap 28 with a cavity 26G that is longitudinally aligned with the lever arm 22, once the lever arm 22 is attached. A tritium vial 24 may be located within the cavity 26 such that the tritium illuminates therethrough. As has been illustrated in some of the previous embodiments, a pair of dimples 44 that are separated by a groove 46 are provided adjacent to the first end 14. When installed in a firearm, a detent (not shown) can be moved between the dimples 44 and guided via the groove 46 between firing modes. As such, in use, the eleventh embodiment would accommodate a lever arm 22 on the right-hand side of the firearm.

Figure 13C:
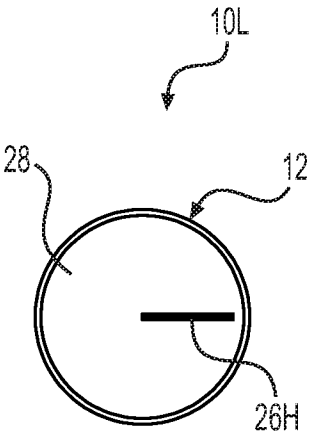
FIG. 13C is an end view of the twelfth embodiment of the safety selector wherein illustrated in FIG. 13A.
Figure 13B:
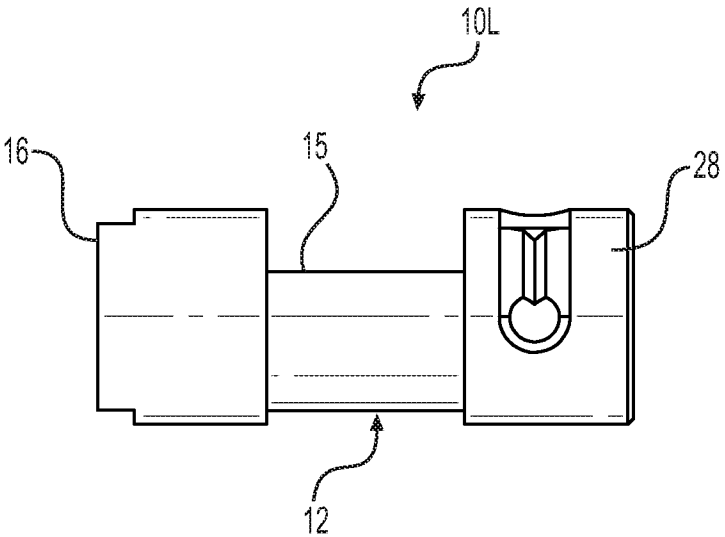
FIG. 13B is a is a side view of the twelfth embodiment of the safety selector illustrated in FIG. 13A.
Figure 13A:
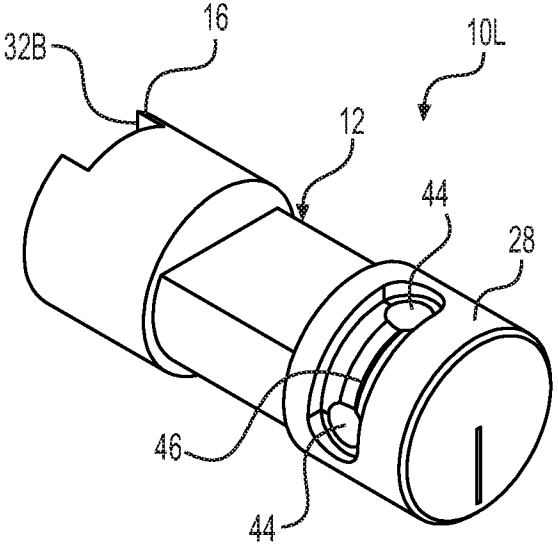
FIG. 13A is a perspective view of a twelfth embodiment of the safety selector illustrating the end cap defining the cavity for receiving and protecting the tritium vial in accordance with another aspect.

FIGS. 13A through 13C illustrate a lock member 12 of a twelfth embodiment of the firearm safety selector 10L. The lock member 12 includes a depression 32B having a rectangular shape located on the second end 16 for receiving correspondingly shaped protrusion 34, similar to that shown in FIG. 9A. The first end 14 of the lock member 12 includes an endcap 28 with a cavity 26 that is longitudinally aligned with the lever arm 22. A tritium vial 24 may be located within the cavity 26H such that the tritium vial 24 and/or tritium 17 illuminates therethrough. The pair of dimples 44 that are separated by the groove 46 are provided adjacent to the first end 16. When installed in a firearm, a detent (not shown) can be moved between the dimples 44 and guided via the groove 46 between firing modes. As such, in use, the twelfth embodiment would accommodate a lever arm 22 on the left-hand side of the firearm.

Figure 14:
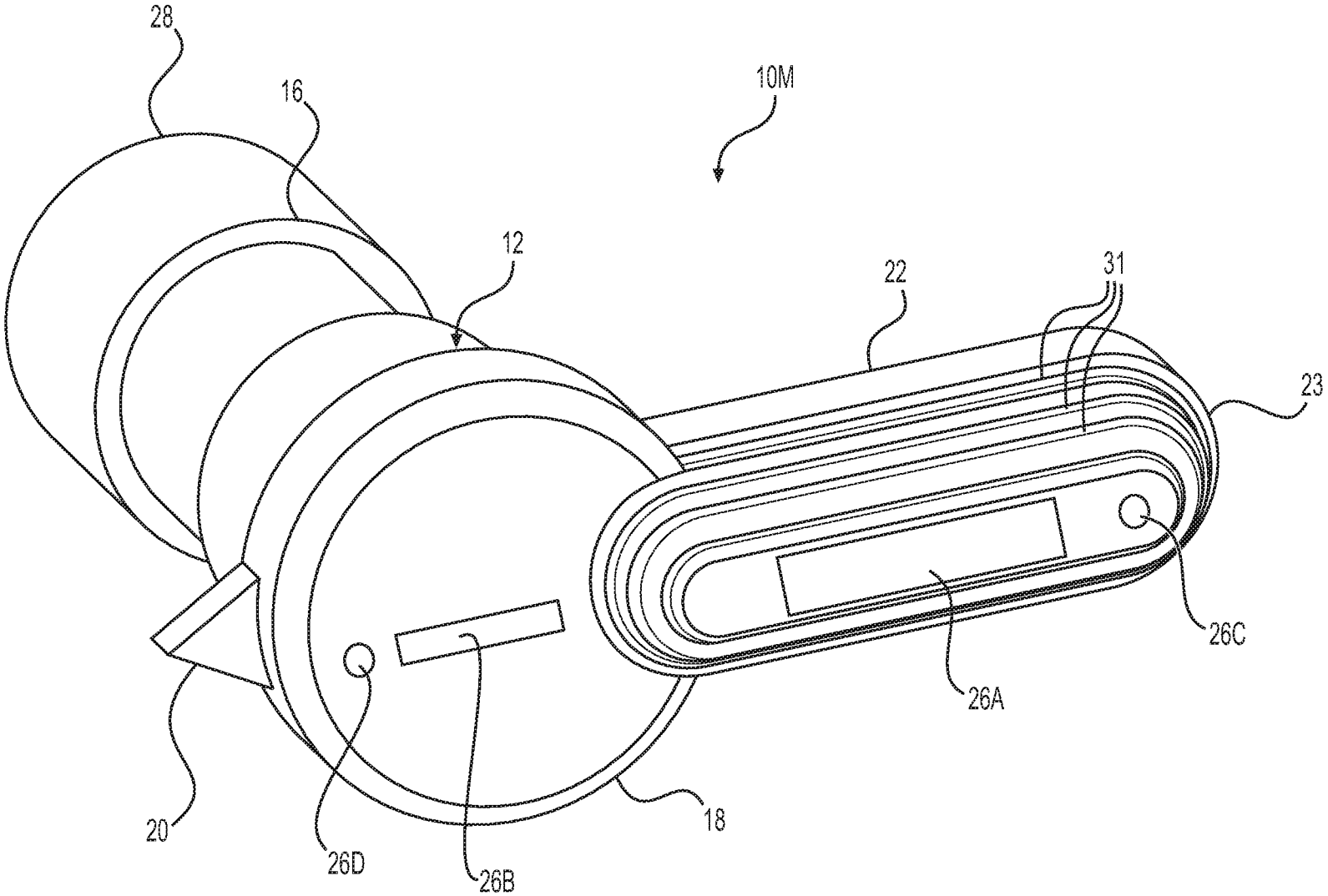
FIG. 14 is a perspective view of a thirteenth embodiment of the safety selector illustrating the lever arm and the faceplate each defining a plurality of cavities for receiving tritium vials.

The multi-piece embodiments presented in FIGS. 9A through 13C may be easily removed from the aperture 13 in the lower receiver 11 when the faceplate 18 and lever arm 22 are removed. As such, various parts and components can be periodically removed to be cleaned, replaced in piecemeal, or otherwise inspected While numerous embodiments have been provided herein it should be appreciated that the various locations of cavities 26 and tritium vials 24 can be combined. As shown in a thirteenth embodiment illustrated in FIG. 14, the lever arm 22 and the faceplate 18 each define multiple cavities 26A, 26B, 26C, 26D with tritium 17 in each cavity 26. Alternatively, the cavities 26A, 26C in the lever arm 22 may share a similar interior space for one source of tritium to illuminate both cavities 26. Similarly, the cavities 26B, 26D in the faceplate 18 may share a similar interior space for one source of tritium to illuminate both cavities 26. Additionally, any of the embodiments with two lever arms 22A, 22B may incorporate various combinations of cavities in one or both lever arms 22A, 22B, such as that presented in FIG. 14. In addition, each embodiment may utilize the casing 30 as shown in FIG. 8 and/or the window 25 in FIG. 2 to provide additional protection to the tritium vial 24 and/or tritium 17. Unless otherwise noted, the window 25 and casing 30 may be used in lieu of or in addition to the vial 24.

The various tritium firearm safety selectors 10 can be incorporated into a variety of firearms, such as rifles, shotguns, handguns, airsoft guns, and the like, to provide the aesthetic and luminary benefits stemming from the use of tritium. Tritium is not battery powered, yet visible in low to no light conditions, whereas traditional firearm safeties and buttons are not. Use of battery powered LEDs is problematic because of the reliance on the life of the battery (tritium has a half-life of 12.3 years). Further, LEDs are often too bright for the eye to adjust rapidly back to a target in a low-light scenario in a combat situation. Tritium is just dim enough to not force the human eye to adjust from down target. These and other advantages of the incorporation of tritium vials into a firearm safety selector should be appreciated in view of the forgoing description.

It should be appreciated that the foregoing description of the embodiments has been provided for purposes of illustration. In other words, the subject disclosure it is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varies in many ways. Such variations are not to be regarded as a departure from the disclosure, and all such modifications are intended to be included within the scope of disclosure.

What is claimed is:

1. A safety selector for a firearm, comprising:
- a lock member extending along an axis A from a first end to a second end;
- a faceplate secured to said first end of said lock member;
- a lever arm extending radially from said faceplate to a radial end for allowing a user to rotate said lock member about said axis A and interchange the firearm between a plurality of firing modes;
- at least one of said faceplate, said lever arm, or said second end defining a first cavity; and
- a tritium vial disposed within said first cavity to provide an indication of the firing mode that is visible in nighttime and low quality of ambient light conditions of the firearm.

2. The safety selector as set forth in claim 1, further comprising a pointer extending radially from said faceplate in opposing and aligned relationship with said lever arm.

3. The safety selector as set forth in claim 2, wherein said first cavity extends in longitudinal and radially aligned relationship with said pointer and said lever arm.

4. The safety selector as set forth in claim 3, wherein said faceplate defines said first cavity.

5. The safety selector as set forth in claim 3, wherein said lever arm defines said first cavity.

6. The safety selector as set forth in claim 2, wherein said first cavity extends axially into said faceplate and is disposed adjacent said pointer.

7. The safety selector as set forth in claim 1, wherein said first cavity extends into said lever arm and is at least partially disposed adjacent said radial end of said lever arm.

8. The safety selector as set forth in claim 1, further including an end cap secured to said second end and wherein said first cavity is located at least partially within said end cap in a longitudinal and radially aligned relationship with said lever arm.

9. The safety selector as set forth in claim 1 further including a second faceplate secured to said second end of said lock member and a second lever arm extending radially from said second faceplate to a second radial end for allowing a user to rotate said lock member from an opposite side of the firearm.

10. The safety selector as set forth in claim 9, wherein said faceplate or said lever arm define said first cavity and wherein said second faceplate and second lever arm define a second cavity having a second tritium vial disposed therein.

11. The safety selector as set forth in claim 1, wherein said lever arm and said faceplate are removeably attached to said first end.

12. The safety selector as set forth in claim 11, wherein said faceplate includes a first protrusion and said first end includes a first depression that is correspondingly shaped for placement of said first protrusion therein.

13. The safety selector as set forth in claim 12, further including a second faceplate and a second lever arm removeably attached to said second end and wherein said second faceplate includes a second protrusion having different shape than said first protrusion and said second end includes a second depression that is correspondingly shaped to said second protrusion for placement of said second protrusion therein.

14. The safety selector as set forth in claim 13, wherein said first protrusion and said first depression are one of rectangular, square, hexagonal, or triangular shaped.

15. The safety selector as set forth in claim 13, wherein said second protrusion and said second depression are a different one of rectangular, square, hexagonal, or triangular shaped.

16. The safety selector as set forth in claim 1, further including a casing comprised of transparent or translucent material located within said first cavity and defining a pocket with said tritium vial located therein.

17. The safety selector as set forth in claim 1, wherein one of said faceplate, said lever arm, or said second end define a second cavity and a second tritium vial is disposed within said second cavity.

18. The safety selector as set forth in claim 17, wherein at least one of said faceplate and said lever arm defines said first cavity and said second end defines said second cavity.

19. The safety selector as set forth in claim 18, wherein said first cavity and said second cavity are both in a longitudinal and radially aligned relationship with said lever arm.

20. The safety selector as set forth in claim 17, wherein said lever arm defines said first cavity and said faceplate defines said second cavity.

* * * * *